US005551358A

United States Patent [19]

Burkhard et al.

[11] Patent Number: 5,551,358

[45] Date of Patent: Sep. 3, 1996

[54] METHOD OF BURNING WASTE, ESPECIALLY PVC WASTE, COMPRISED ESSENTIALLY OF PLASTIC

[75] Inventors: Theo Burkhard, Gummersbach; Christoph Schmid, Bergneustadt; Hans Sobolewski, Wiehl, all of Germany

[73] Assignee: L. & C. Steinmüller GmbH, Gummersbach, Germany

[21] Appl. No.: 313,025

[22] PCT Filed: Jan. 21, 1994

[86] PCT No.: PCT/EP94/00156

§ 371 Date: Nov. 18, 1994

§ 102(e) Date: Nov. 18, 1994

[87] PCT Pub. No.: WO94/17332

PCT Pub. Date: Aug. 4, 1994

[30] Foreign Application Priority Data

Jan. 23, 1993 [DE] Germany ..... 43 01 814.9

[51] Int. Cl.[6] ..... F23G 1/00

[52] U.S. Cl. ..... 110/346; 110/246; 110/347

[58] Field of Search ..... 110/246, 342, 110/346, 347

[56] References Cited

U.S. PATENT DOCUMENTS

| | | |
|---|---|---|
| 3,716,339 | 2/1973 | Shigaki et al. . |
| 4,846,083 | 7/1989 | Serbent . |
| 4,953,481 | 9/1990 | Clayton . |

FOREIGN PATENT DOCUMENTS

| | | |
|---|---|---|
| 0419992 | 4/1991 | European Pat. Off. . |
| 3316299 | 11/1984 | Germany . |
| 3327448 | 2/1985 | Germany . |
| 3444073 | 6/1986 | Germany . |
| 59-183209 | 10/1984 | Japan . |

OTHER PUBLICATIONS

Von Dieter O. Reimann; Chlorverbindungen . . . PVC; Jun. 1984; pp. 169–176.

*Primary Examiner*—John T. Kwon
*Attorney, Agent, or Firm*—Robert W. Becker & Associates

[57] ABSTRACT

A method of burning waste comprised essentially of plastic, especially PVC waste. The waste is burned in a revolving cylindrical furnace accompanied by the addition to the waste of at least one finely ground solid additive having at least one component with a melting temperature higher than the melting temperature of the plastic of the waste.

10 Claims, 1 Drawing Sheet

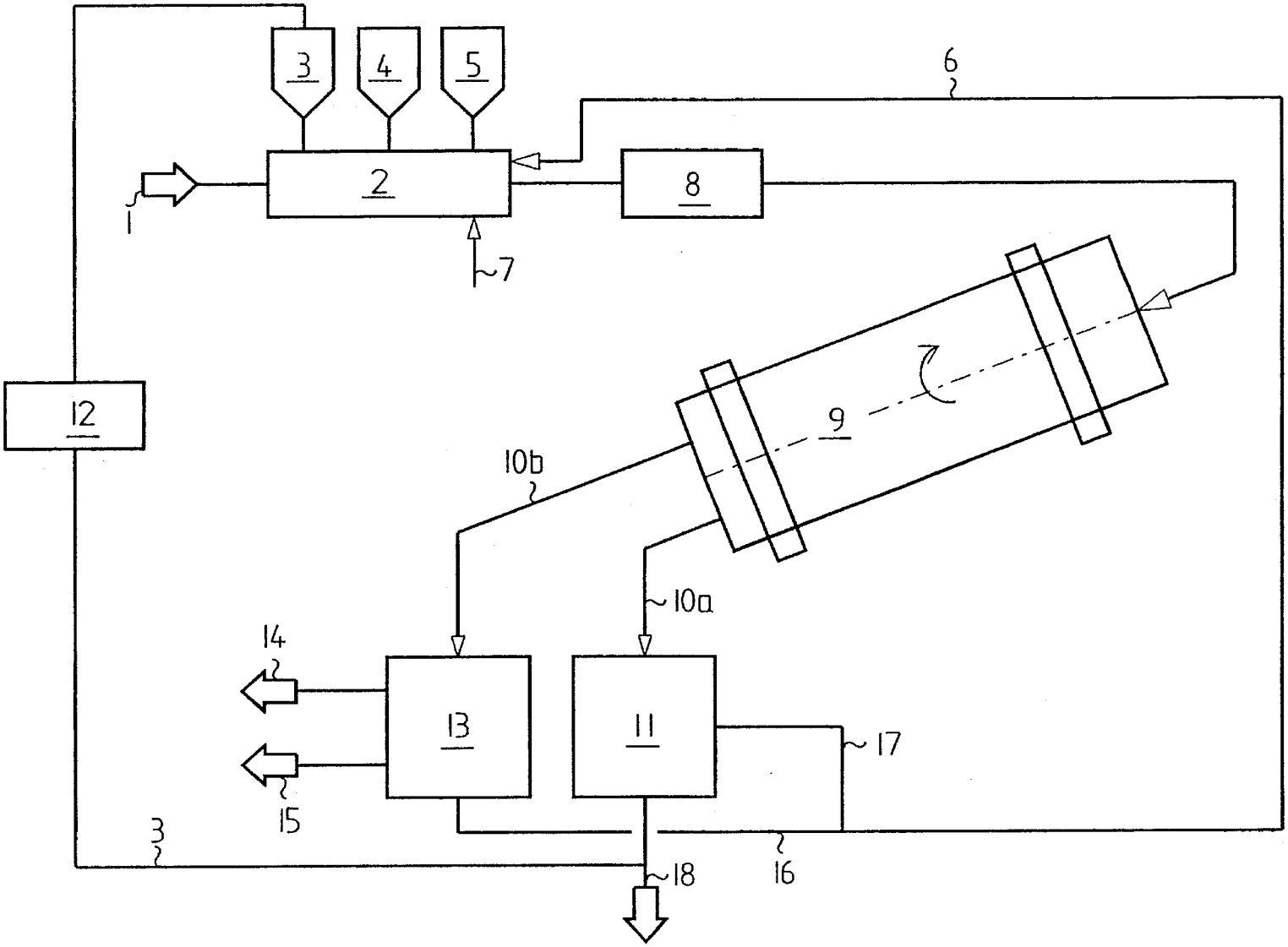
6
8
9
5
4
3
2
7
1
12
10a
10b
11
13
17
16
18
14
15
3

METHOD OF BURNING WASTE, ESPECIALLY PVC WASTE, COMPRISED ESSENTIALLY OF PLASTIC

BACKGROUND OF THE INVENTION

The present invention relates to a method of burning waste comprised essentially of plastic, especially PVC waste.

It is known (German Publication "Müll und Abfall", 6/84, Pages 169–175) to collect plastic, especially PVC plastic, separately from household refuse and to burn it in a combustion unit. In addition to being generated in household refuse, plastic also results as a residual product in industry, for example during the manufacture of windows and the like, during building renovation or the like.

During the combustion of waste that comprises essentially plastic in a combustion unit that is provided with grate firing, there exists the danger that due to the low melting point of the plastic waste, for example in a temperature range of 70°–200° C., molten plastic falls through the grating into the air boxes and is thus lost to the combustion.

It is an object of the present invention to provide a method of the aforementioned general type that essentially guarantees a more complete combustion.

SUMMARY OF THE INVENTION

This object is realized in that the waste comprised essentially of plastic (plastic waste) is burned in a revolving cylindrical furnace accompanied by the addition of at least one finely ground solid additive having at least one component with a melting temperature higher than the melting temperature of the plastic.

Due to the combustion in the revolving cylindrical furnace, and due to the addition of the finely ground solid additive, the pyrolysis phase during the combustion of the plastic (melting of the plastic, softening and partial combustion of volatile components and coking) are influenced in such a way that the coke that is formed does not cake up the revolving cylindrical furnace and has a looser structure that burns as efficiently as possible. This can essentially be attributed to the fact that after the plastic melts it becomes disposed upon the finely ground additive, thus making available a considerably greater surface area for the further steps of the pyrolysis phase. In other words, a coke structure is formed that leads to a substantially more complete combustion. It is preferred that such an additive be used that even at the end of the combustion the melting temperature of the at least one component is not reached. The temperature at the end of the revolving cylindrical furnace can, for example, be in the range of from 1100°–1300° C. The terminology "melting temperature of the plastic" in the specification and the claims also includes a temperature window, since with a mixture of various plastics one cannot expect a uniform melting temperature of the plastic components. The window can be between 70° and 200° C., but preferably between 80° and 150° C.

Due to the combustion in a revolving cylindrical furnace, an adequate retention time for the essentially uniform distribution of the softened or melted plastic upon the particles of the solid additive is ensured. Although the combustion of solid waste, especially specialty waste, industrial waste or the like, in a rotary kiln has already been proposed, with the general combustion of plastic waste caking and complete combustion problems can occur.

In a preferred manner, as the finely ground solid additive one or more additives from the following group are selected: quartz sand, fine gravel, stone chippings, bauxite, pure clay, oxidized ore, waste glass, granite, residue from combustion, especially slag, lignite, bituminous coal, especially highly volatile bituminous coal, asphalt road surface that has been reduced in size, chips of old tires.

With a portion of the aforementioned additives, in addition to the additives a fuel is also introduced into the process to enlarge the surface area in the event that the heating value of the plastic waste is not adequate by itself. With fuels an additional effect can be achieved in that the volatile constituents, by means of gasification, also contribute to a loosening of the coke structure and hence to an improved combustion.

With the combustion of PVC plastic waste, one must take into consideration that this plastic waste has a high proportion of chlorine and in addition, as with other plastics, contains at least one additive. Such additives are, for example, stabilizers in the form of inorganic heavy metal salts, metallic soaps, especially of Ba, Cd, Pb, Zn, Ca and other metallic-organic compounds. Furthermore, PVC can also be protected against UV light, by having UV absorbers added thereto. To provide color to plastic products, inorganic and organic pigments are added. Furthermore, plasticizers may be required. In addition to the additives mentioned up till now, plastic mixtures can also contain other additives, such as propellants, adhesives, fillers, lubricants, antistatic agents, fungicides, and the like; with regard to quantity, the fillers are of particular significance since they can be present in the plastic, especially in PVC, up to 50% by weight.

When a plastic, especially PVC, is used that contains at least one additive, the finely ground solid additive is such a one that together with the additive leads to an extract-resistant residue from combustion.

In a particularly preferred manner, when plastic is burned that has an alkali and/or alkaline earth containing filler, an $SiO_2$ and/or $Al_2O_3$ containing additive is used; for this purpose, one can use additives from the group of: quartz sand, fine gravel, stone chippings on the one hand, or bauxite, pure clay on the other hand, as well as combustion residue that is produced during the combustion of the plastic waste and that has possibly been reduced in size. Constituents introduced with the other additives can also be bonded in a partially extract-resistant manner by the formation of silicates and/or aluminates.

Furthermore, the silicate and/or aluminate formation offers the advantage that the desired recovery of the chlorine fraction can be quantitatively optimized since during the combustion there is no extensive formation of water soluble calcium chloride.

It is expedient to reduce the size of the plastic waste prior to the combustion. It also appears to be expedient to mix the plastic waste and the solid, finely ground additive together prior to introduction into the revolving cylindrical furnace. The mixture can be stabilized by adding a wetting liquid. A calcium chloride solution can be used as a wetting agent, especially a calcium chloride solution that results during the cleaning of the flue gas accompanied by simultaneous recovery of hydrogen chloride as washings. This discharge can also have a slurry-like consistency. The recovery of hydrogen chloride from the flue gas during the combustion of PVC is part of the state of the art and need not be described in greater detail here.

It is also possible to use as a mixing aid either the washings from the extraction treatment of the combustion residue alone or in admixture with the washings from the flue gas treatment.

The inventive method also offers a simple possibility of removing finely ground solid materials that are contaminated with organic compounds, especially chlorine containing hydrocarbons, in that pursuant to the teaching of the present invention they are introduced into the revolving cylindrical furnace as finely ground additives. This addresses in particular contaminated ground that is formed from contaminated sands and/or gravel.

BRIEF DESCRIPTION OF THE DRAWING

The inventive procedure will now be described in detail with the aid of the accompanying drawing, which is a diagrammatic flow diagram illustrating one exemplary embodiment of the inventive method.

DESCRIPTION OF PREFERRED EMBODIMENTS

PVC-waste 1 is continuously or intermittently supplied to a mixer 2. This mixer can have various configurations, for example it can be a paddle mixer, a mixing screw, a plowshare mixer, or the like. In the mixer 2 the PVC waste is mixed with recirculated residue from combustion 3, quartz sand 4, and lignite 5 accompanied by the addition of aqueous calcium chloride slurry 6. It can also be possible to just add water 7 in place of the slurry. It is to be understood that the drawing illustrates only one exemplary embodiment; in view of the foregoing explanations in the introduction to the specification, the supply of one of the finally ground solid additives 3, 4 or 5 may be sufficient. However, with regard to the calcium chloride slurry that originates from the flue gas scrubbing or purification, it is expedient that it be returned in its entirety to the combustion since the calcium chloride itself has no appreciable possibility for use.

The mixture is conveyed via a feed mechanism 8 to a revolving tubular or cylindrical kiln or furnace 9, which could also be provided with a secondary combustion chamber.

As already mentioned above, of the additives to the PVC, the quantity of the chalk ($CaCO_3$) is of particular significance. In the revolving cylindrical furnace, by using $SiO_2$ additives, the following reactions are brought about:

$$CaCO_3+SiO_2=CaSiO_3+CO_2$$

$$CaO+SiO_2=CaSiO_3.$$

By means of these reactions, an extract-resistant Ca compound is synthesized, essentially avoiding that to any significant extent a formation of calcium chloride occurs. For the residue of calcium chloride formation, the following equation applies:

$$CaCl_2+SiO_2+H_2O=CaSiO_3+HCl.$$

The calcium carried along by the PVC is converted into a nearly insoluble calcium silicate. Tests have shown that the reaction of the $SiO_2$ With the calcium chloride at temperatures above 1000° C. occurs practically entirely from the left toward the right. The residue from combustion 3, the sand 4, and the inert components of the lignite 5 lead to a looser or less compact structure of the coke that is formed during the combustion, as a result of which an essentially complete combustion is achieved.

The residue from combustion 10*a* that is withdrawn from the revolving cylindrical furnace 9 is subjected in a residue from combustion treatment unit 11 to a known washing and possibly to a heavy metal extraction. A portion 3 of the residue from combustion is, as described previously, conveyed to the mixer 2 after being reduced in size or pulverized in the unit 12.

The flue gas 10*b* that is withdrawn from the revolving cylindrical furnace is conveyed to a flue gas treatment unit 13, from which scrubbed or purified flue gas 14 and hydrogen chloride 15 as well as a $CaCl_2$ containing flue gas treatment washings 16 are withdrawn. These washings can either be conveyed alone to the mixer 2 or together with the washings 17 of the residue from combustion treatment unit after precipitation of heavy metals. At 18, the portion of the extract-resistant residue from combustion that is not returned to the mixer is withdrawn. If no return of residue from combustion is intended, the entire quantity of residue from combustion is withdrawn at 18.

Especially when PVC waste is burned, the inventive method offers the advantage that the coke structure is loosened up in a manner that facilitates the combustion, that at least a significant portion of the additives present in the PVC are converted into extract-resistant residue from combustion, and that a relatively high proportion of the hydrogen chloride produced during the combustion can be recovered. It is to be understood that the heat that is released during the combustion can be utilized by heat exchange with the flue gas, especially for the generation of steam.

The plastic waste does not necessarily consist of a full 100% plastic, since impurities, such as hardware components in the case of plastic windows, can be present and would be introduced into the revolving cylindrical furnace.

The present invention is, of course, in no way restricted to the specific disclosure of the specification and drawing, but also encompasses any modifications within the scope of the appended claims.

We claim:

1. A method of burning waste comprised essentially of plastic, said method including the steps of:

burning said waste in a revolving cylindrical furnace accompanied by the addition to said waste of at least one finely ground solid additive, wherein said at least one solid additive has at least one component with a melting temperature higher than the melting temperature of said plastic of said waste, and wherein said at least one finely ground solid additive, together with at least one additive contained in said plastic, leads to the formation of an extract-resistant residue from said burning.

2. A method according to claim 1, wherein said at least one additive has such a melting temperature that even at a conclusion of said burning step said melting temperature of said at least one component has not been reached.

3. A method according to claim 1, wherein said at least one additive is selected from the group consisting of quartz sand, fine gravel, stone chippings, bauxite, pure clay, oxidized ore, waste glass, granite, residue from combustion, slag, lignite, bituminous coal, highly volatile bituminous coal, asphalt road surface material that has been crushed, and chips of old tires.

4. A method according to claim 1, wherein said plastic is PVC.

5. A method according to claim 1, which, for burning plastic that has at least one filler selected from the group consisting of alkali and alkaline earth containing fillers, includes the step of using an additive selected from the group consisting of $SiO_2$ and $Al_2O_3$ containing additives.

6. A method according to claim 1, which includes the step of using as said at least one finely ground solid additive residue from the combustion of said waste plastic itself.

7. A method according to claim 1, which includes the step of reducing the size of said plastic waste prior to said burning step.

8. A method according to claim 1, which includes the steps of first mixing together said waste and said at least one finely ground solid additive to form a mixture, and then introducing said mixture into said revolving cylindrical furnace.

9. A method according to claim 8, which includes the step of adding a wetting liquid to said mixture prior to said step of introducing said mixture into said revolving cylindrical furnace.

10. A method according to claim 9, which includes the step of using as said wetting liquid a calcium chloride solution that is produced during a cleaning of a flue gas that results during the combustion of waste comprising PVC plastic.

* * * * *